US010010231B2

(12) United States Patent
Knutson et al.

(10) Patent No.: US 10,010,231 B2
(45) Date of Patent: Jul. 3, 2018

(54) WATER TRAILING DETECTION SYSTEM

(71) Applicant: Nilfisk A/S, Brøndby (DK)

(72) Inventors: Kipp Knutson, Plymouth, MN (US); Stuart McDonald, Minnetonka, MN (US); Stephen Klopp, Champlin, MN (US); John Black, Plymouth, MN (US); Dave Wood, Plymouth, MN (US); Donald Joseph Legatt, St. Michael, MN (US)

(73) Assignee: NILFISK A/S, Brondby (DK)

( * ) Notice: Subject to any disclaimer, the term of this patent is extended or adjusted under 35 U.S.C. 154(b) by 0 days.

(21) Appl. No.: 15/240,988

(22) Filed: Aug. 18, 2016

(65) Prior Publication Data

US 2017/0049287 A1 Feb. 23, 2017

Related U.S. Application Data

(60) Provisional application No. 62/206,674, filed on Aug. 18, 2015.

(51) Int. Cl.
*A47L 11/29* (2006.01)
*A47L 11/40* (2006.01)
(Continued)

(52) U.S. Cl.
CPC ..... *A47L 11/4011* (2013.01); *A47L 11/1625* (2013.01); *A47L 11/201* (2013.01);
(Continued)

(58) Field of Classification Search
CPC ..... A47L 11/30; A47L 11/302; A47L 11/305; A47L 11/201; A47L 11/4011;
(Continued)

(56) References Cited

U.S. PATENT DOCUMENTS 2,930,055 A * 3/1960 Fallen ..... A47L 11/1625 15/320
4,275,478 A * 6/1981 Kohlenberger ..... A47L 11/34 15/322
(Continued)

FOREIGN PATENT DOCUMENTS

DE 3536974 A1 4/1987
WO WO-2015/007315 A1 1/2015
WO WO-2017031364 A1 2/2017

OTHER PUBLICATIONS

"International Application Serial No. PCT/US2016/047637, International Search Report dated Nov. 15, 2016", 2 pgs.
(Continued)

*Primary Examiner* — David Redding
(74) *Attorney, Agent, or Firm* — Schwegman Lundberg & Woessner, P.A.

(57) ABSTRACT

A floor cleaning machine can comprise a chassis, a cleaning mechanism, a control system, and a cleaning operation sensing system connected to the chassis. The chassis can be configured for movement along a cleaning path. The cleaning mechanism can perform a cleaning operation. The liquid system can provide liquid to the cleaning mechanism. The recovery system can recover liquid from the cleaning operation. The control system can control performance of the cleaning operation. The cleaning operation sensing system can detect a condition of the cleaning operation. The cleaning operation sensing system can comprise a water trailing detection system comprising: a frame connected to the chassis aft of the recovery system, an absorbent medium connected to the frame; and a moisture sensor in communication with the control system to alter a signal in response to moisture in the absorbent medium.

17 Claims, 9 Drawing Sheets

(51) Int. Cl.

| | |
|---|---|
| ***A47L 11/30*** | (2006.01) |
| ***A47L 11/20*** | (2006.01) |
| ***A47L 11/206*** | (2006.01) |
| ***A47L 11/162*** | (2006.01) |

(52) U.S. Cl.
CPC ..... *A47L 11/2065* (2013.01); *A47L 11/305* (2013.01); *A47L 11/4016* (2013.01); *A47L 11/4036* (2013.01); *A47L 11/4038* (2013.01); *A47L 11/4044* (2013.01); *A47L 11/4061* (2013.01); *A47L 11/4083* (2013.01); *A47L 11/4088* (2013.01); *A47L 11/302* (2013.01); *A47L 2201/04* (2013.01)

(58) Field of Classification Search
CPC ..... A47L 11/1625; A47L 11/4036; A47L 11/4088; A47L 11/2065; A47L 11/4083; A47L 11/4016; A47L 11/4061; A47L 2201/04; A47L 11/29
IPC ..... A47L 11/29
See application file for complete search history.

(56) References Cited

U.S. PATENT DOCUMENTS

| | | | | |
|---|---|---|---|---|
| 6,042,656 | A * | 3/2000 | Knutson | A47L 7/0009 134/21 |
| 6,832,407 | B2 | 12/2004 | Salem | |
| 7,454,846 | B2 | 11/2008 | Brobeck | |
| 8,528,142 | B1 | 9/2013 | Pedlar et al. | |
| 8,855,813 | B2 | 10/2014 | Ziegler et al. | |
| 8,887,340 | B2 | 11/2014 | Pedlar et al. | |
| 2004/0244138 | A1 | 12/2004 | Taylor et al. | |

OTHER PUBLICATIONS

"International Application Serial No. PCT/US2016/047637, Written Opinion dated Nov. 15, 2016", 6 pgs.
"Machine Translation of DE 3536974A1, published Apr. 23, 1987", 5 pgs.

* cited by examiner

WATER TRAILING DETECTION SYSTEM

CLAIM OF PRIORITY

This application is related and claims priority to U.S. Provisional Application No. 62/206,674, filed on Aug. 18, 2015 and entitled "WATER TRAILING DETECTION SYSTEM," the entirety of which is incorporated herein by reference.

TECHNICAL FIELD

The present patent application relates generally to a cleaning apparatus. More specifically, the present patent application relates, but not by way of limitation, to sensing systems for determining the performance of robotic and manual floor cleaning machines.

BACKGROUND

Industrial and commercial floors are cleaned on a regular basis for aesthetic and sanitary purposes. There are many types of industrial and commercial floors ranging from hard surfaces such as concrete, terrazzo, wood, and the like, which can be found in factories, schools, hospitals, and the like, to softer surfaces such as carpeted floors found in restaurants and offices. Different types of floor cleaning machines such as scrubbers, sweepers, and extractors, have been developed to properly clean and maintain these different floor surfaces.

For example, a typical industrial or commercial scrubber is a walk-behind or drivable, self-propelled, wet process machine that applies a liquid cleaning solution from an on-board cleaning solution tank onto the floor through nozzles. Rotating brushes forming part of the scrubber agitate the solution to loosen dirt and grime adhering to the floor. The dirt and grime become suspended in the solution, which is collected by a vacuum squeegee fixed to a rearward portion of the scrubber and deposited into an onboard recovery tank.

Floor cleaning machines can also be designed as unmanned, robotic units that operate autonomously. However, there are particular challenges in automating the cleaning process of an autonomous scrubber, particularly for large, industrial or commercial floor cleaning machines that can be employed unsupervised in areas where there is pedestrian traffic. In addition to providing an adequate guidance or navigation system that prevents the unmanned, robotic unit from engaging objects or entering prohibited areas, the cleaning operation itself must be managed to ensure the unmanned, robotic unit is actually performing the cleaning operation as intended. Similarly, during manned operation of floor cleaning machines, it can sometimes be difficult for the operator to visually or manually recognize a potential deficiency in the cleaning process.

OVERVIEW

The present inventors have recognized, among other things, that a problem to be solved with floor cleaning machines is the inability to recognize when the cleaning operation is deficient, potentially failing or failing. In particular, a problem to be solved with autonomous or robotic floor cleaning machines is that such machines often cannot automatically detect conditions of the cleaning process that might require corrective action. Such conditions are frequently recognizable by a user of manually operated floor cleaning equipment. However, sometimes it can even be difficult for manual operators of floor cleaning equipment to recognize when the cleaning operation may be deficient. For example, in manually operated floor cleaning equipment, the operator typically sits in front of a recovery system looking forward and is not looking back for water trailing. Furthermore, water trailing from deficient squeegee blades or vacuum recovery systems can result in streaking of the floor that is difficult to visually perceive.

The present subject matter can help provide a solution to these and other problems such as by providing a robotic or autonomous cleaning machine that can include a control system to monitor the status of the cleaning operation. For example, the control system can be connected to a sensor system connected to the cleaning machine that can determine the presence of moisture left behind by the cleaning machine.

In an example, a floor cleaning machine can comprise a chassis, a cleaning mechanism, a liquid system, a recovery system, a control system, and a cleaning operation sensing system. The chassis can be configured for movement along a cleaning path. The cleaning mechanism can be connected to the chassis to perform a cleaning operation. The liquid system can be connected to the chassis to provide liquid to the cleaning mechanism. The recovery system can be connected to the chassis to recover liquid from the cleaning operation. The control system can be connected to the floor cleaning machine to control performance of the cleaning operation. The cleaning operation sensing system can be connected to the control system to detect a condition of the cleaning operation.

In another example, a moisture detection system for a floor cleaning machine configured to drive along a cleaning path can comprise a frame, electrodes, and a sensor electronics system. The frame can be connected to a cleaning machine. The electrodes can be connected to the frame for engaging moisture along the cleaning path. The sensor electronics system can be connected to the electrodes to determine presence of moisture at the electrodes.

In yet another example, a floor cleaning machine can comprise a chassis, a cleaning mechanism, a liquid system, a recovery system, a control system, and a water trailing detection system. The chassis can have a forward end and an aft end and can be configured for movement along a cleaning path. The cleaning mechanism can be connected to the chassis to perform a cleaning operation. The liquid system can be connected to the chassis to provide liquid to the cleaning mechanism. The recovery system can be connected to the chassis aft of the cleaning mechanism to recover liquid from the cleaning operation. The control system can be connected to the floor cleaning machine to control performance of the cleaning operation. The water trailing detection system can comprise: a frame connected to the chassis aft of the recovery system; an absorbent medium connected to the frame; and a moisture sensor in communication with the control system and configured to alter a signal in response to moisture in the absorbent medium.

DETAILED DESCRIPTION

Figure 1:
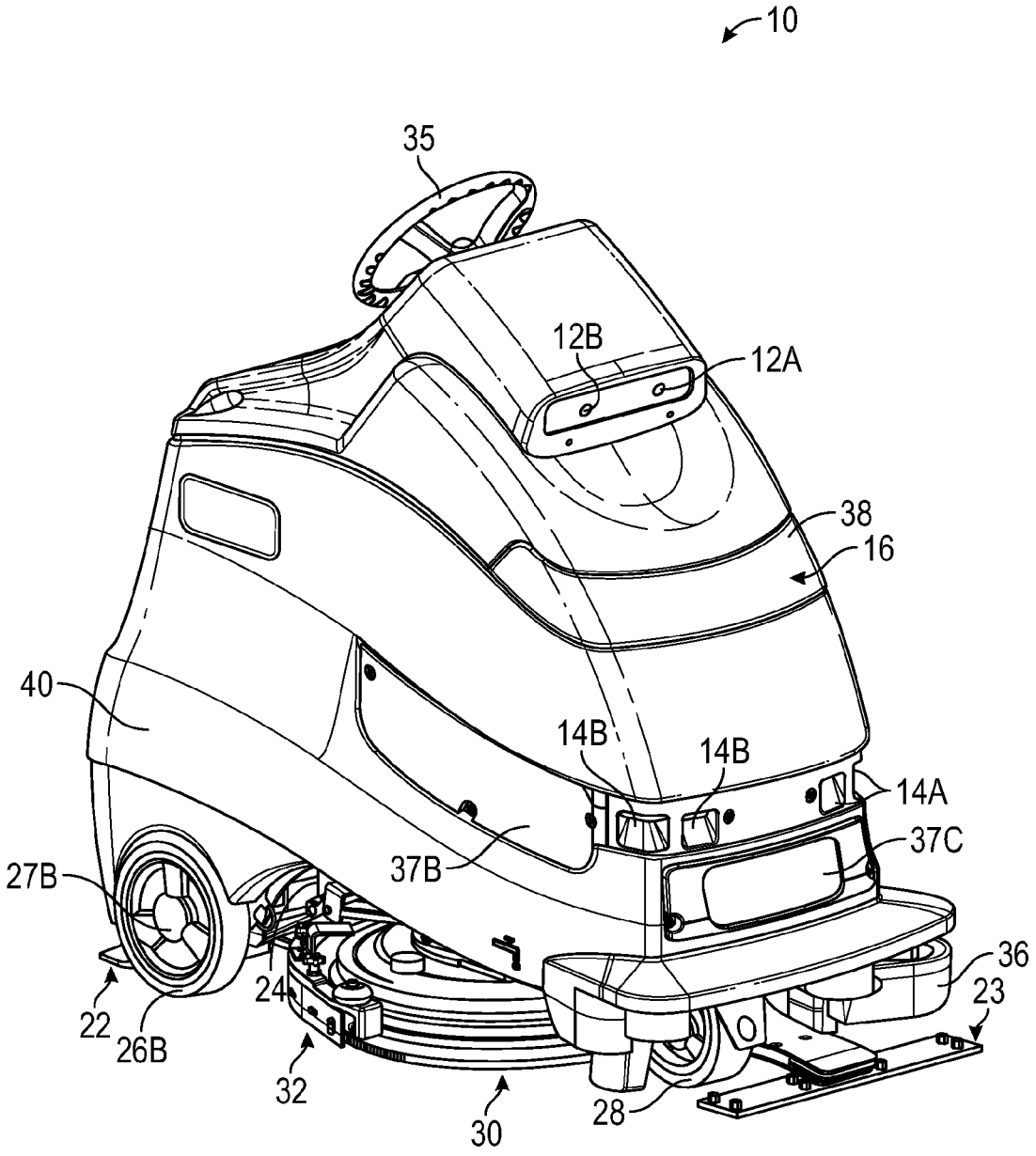
FIG. 1 is a front perspective view of a robotic floor cleaning machine having optical sensors, distance sensors, a laser scanner and a trailing mop system with moisture-sensing capabilities.
Figure 2:
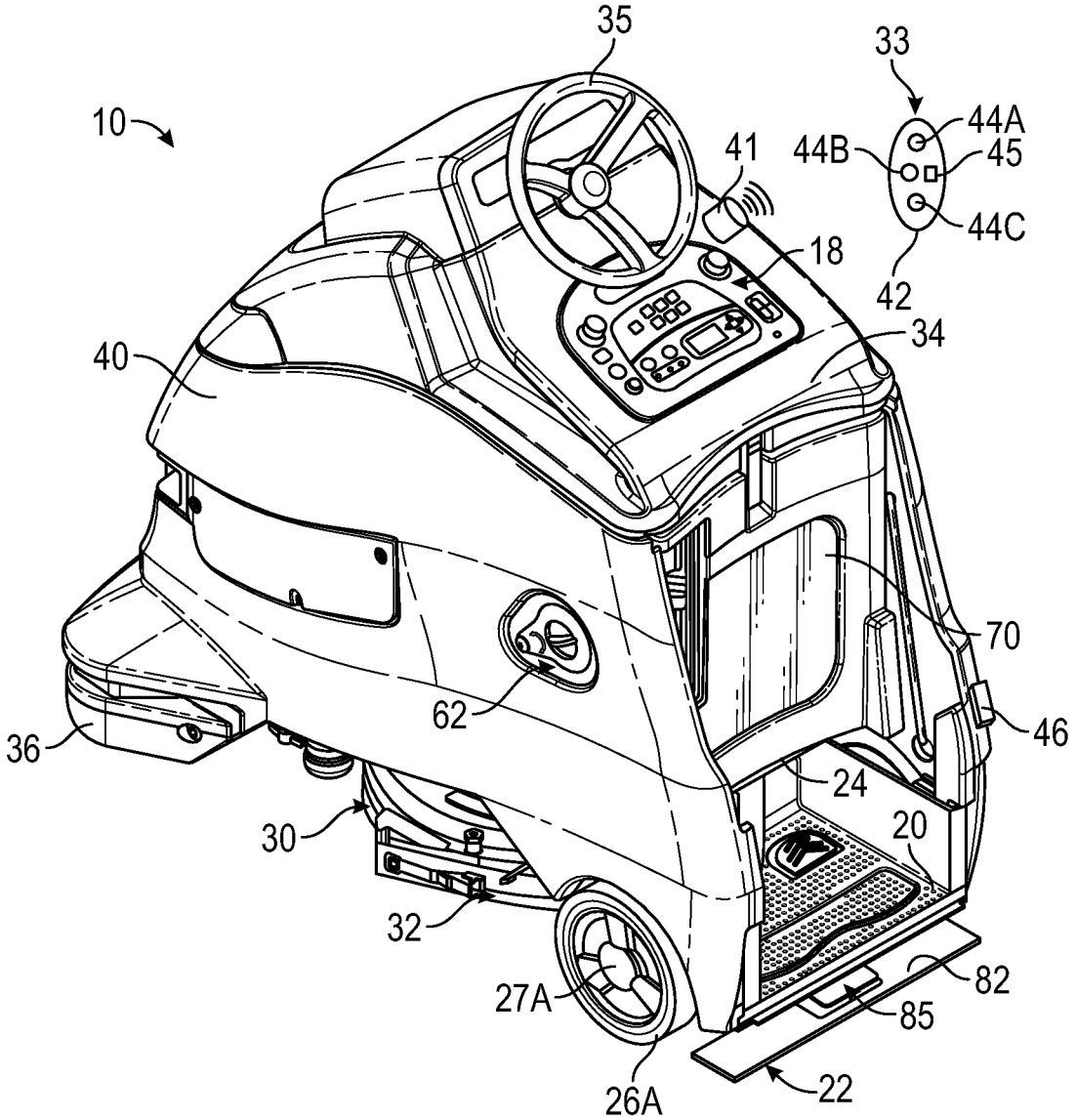
FIG. 2 is a rear perspective view of the robotic floor cleaning machine of FIG. 1 showing a control panel, an operator platform and the trailing mop system.

FIG. 1 is a front perspective view of floor cleaning machine 10 having optical sensors 12A and 12B, distance sensors 14A and 14B, and a status light system 16. FIG. 2 is a rear perspective view of floor cleaning machine 10 of FIG. 1 showing control panel 18, operator platform 20, and trailing mop system 22. Machine 10 can include chassis 24 to which wheels 26A, 26B and 28 can be connected. Chassis 24 can support various cleaning devices, such as trailing mop system 22, forward mop system 23, scrubber 30 and squeegee 32. Chassis 24 can be connected to or form part of platform 20. Control panel 18, which can operate scrubber 30, squeegee 32 and trailing mop system 22, can be in electronic communication with remote device 33 and display 34 (FIG. 2). FIGS. 1 and 2 are discussed concurrently.

Floor cleaning machine 10 can be configured to clean, treat, scrub, or polish a floor surface, or perform other similar actions using, for example, trailing mop system 22, scrubber 30 and squeegee 32. An operator can stand on platform 20 and control machine 10 using control panel 18 and steering wheel 35. Alternatively, optical sensors 12A and 12B and distance sensors 14A and 14B, as well as laser scanner 36 and personnel detectors 37A-37C, can allow machine 10 to autonomously drive itself The present application describes various features that can be used to facilitate autonomous cleaning and autonomous driving of machine 10. The features described in the present application can be applied to any type of floor cleaning equipment, such as scrubbers, sweepers, and extractors, whether autonomous or user operated.

Platform 10 can support the weight of an operator in a standing position. In other examples, machine 10 can be configured to accommodate a sitting operator. Machine 10 can be of a three-wheel design having two wheels 26A and 26B generally behind the center of gravity of machine 10 and one wheel 28 in front of the center of gravity. In an example, platform 20 can be located behind the center of gravity. Front wheel 28 can be both a steered wheel and a driven wheel. Front wheel 28 can have a device for determining the angular position of the driving direction about the steering axis. In an example, rear wheels 26A and 26B are not driven but have one or more devices, such as encoders 27A and 27B, respectively, for determining speed of rotation each wheel. The angular position of each wheel 26A and 26B, and the angular position and steering angle of wheel 28 can be used to determine the position of machine 10 relative to objects sensed by optical sensors 12A and 12B and distance sensors 14A and 14B, as well as laser scanner 36, in mapping an environment of machine 10.

Figure 4:
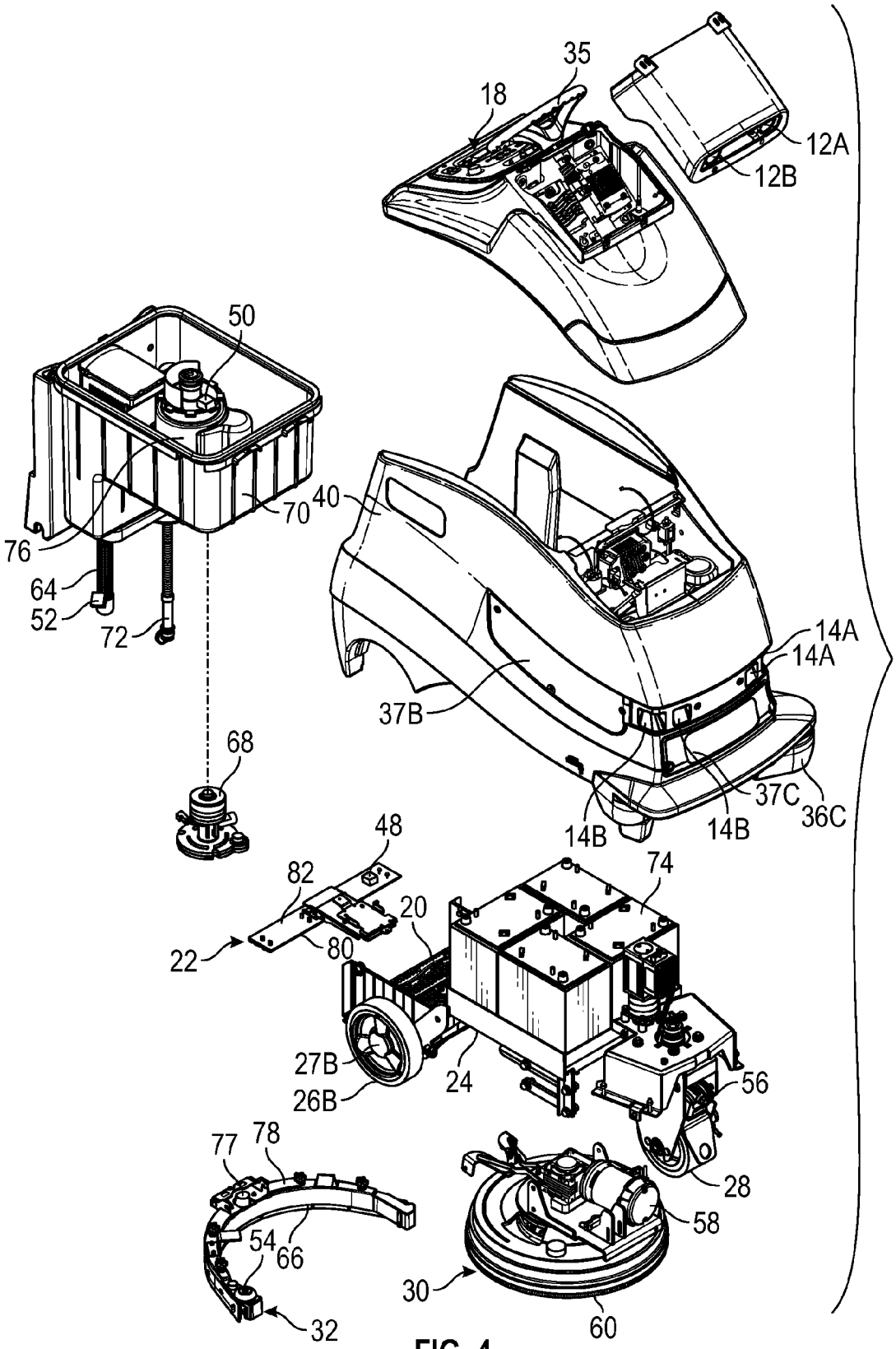
FIG. 4 is an exploded view of the robotic floor cleaning machine of FIG. 3 showing the frame, the absorbent material and the sensor.

Machine 10 can be electrically operated and can include a battery e.g., battery 74 of FIG. 4) for powering the various components of machine 10. Motors (not shown) within machine 10 or steering wheel 35 can be used to turn wheel 28, such as during autonomous operation of machine 10. Additionally, wheel 28 can be connected to a prime mover, such as an electric motor (e.g., motor 56 of FIG. 4), that provides propulsive force to machine 10.

Scrubber 30 can be configured to provide a cleaning action to the floor, such as rotary disc, orbital or cylindrical cleaning. In other examples, machine 10 can be configured to have a cleaning mechanism that provides other cleaning action, such as suction or vacuum cleaning actions. Fluid from a liquid cleaning system disposed within main cowling 40 can be dispensed by machine 10 to facilitate scrubbing performed by scrubber 30. A liquid system can include a liquid storage tank, a pump system, and spray nozzles, as discussed below. Squeegee 32 can be used to corral or wipe dirty fluid behind scrubber 30 and can be connected to a recovery system having a tank (e.g., tank 70 of FIG. 4) disposed within main cowling 40. A recovery system can include a suction tube (e.g., hose 64), a suction motor e.g., motor 68), and a storage tank (e.g., tank 70).

Optical sensors 12A and 12B, distance sensors 14A and 14B, and laser scanner 36, as well as the other sensors described herein, can be collectively referred to as a guidance or navigation system for machine 10 when operatively connected to control panel 18 as described herein. Machine 10 can also include other types of sensors to facilitate autonomous guidance, such as ambient light sensors. Optical sensors 12A and 12B can comprise video cameras that can record the environment of machine 10. Distance sensors 14A and 14B can comprise active ultrasonic sonar sensors or laser sensors that can generate high-frequency sound waves and evaluate the echo which is received back by the sensor, measuring the time interval between sending the signal and receiving the echo to determine the distance to an object. Laser scanner 36 can generate three-dimensional data of the space around machine 10.

Control panel 18 can be connected to electronics programmed to generate mapping of locations that machine 10 has visited. Thus, as machine 10 is used throughout a facility, control panel 18 can add new places to the map and continuously refine the mapping of existing places, using the angular position of wheels 26A, 26B and 28. Machine 10 can use optical sensors 12A and 12B, distance sensors 14A and 14B, and laser scanner 36 to recognize the surroundings of machine 10 to place machine 10 into the mapped area. Both two-dimensional and three-dimensional mapping can be logged into memory of electronics connected to control panel 18. Thus, routes for the cleaning paths of vehicle 10 can be recorded in the mapped area for various cleaning operations. The cleaning path routes can be generated by an operator of machine 10 or automatically by control panel 18. Machine 10 can provide an indication to an operator regarding the status of the location of machine 10 relative to the mapped area. For example, status light system 16 can light up in a particular pattern or color to indicate that machine 10 is in a known location, is currently mapping a new location, is paused, or some other such indication.

Status light system 16 can be provided to communicate various statuses of machine 10 to the operator, other personnel or other pedestrians in the line-of-sight of machine 10 and status light system 16. Status light system 16 can include one or more visual indicators, such as light-emitting diodes (LEDs) or other light sources. The light bulbs can be positioned behind lens 38 to convey information to people in proximity of machine 10. For example, a solid white light can indicate that the machine is ready for operation, green can indicate that machine 10 is actively and correctly performing a cleaning operation, a flashing blue light on one side of machine 10 can indicate that machine 10 is about to make a turn to the side of the flashing blue light, a yellow light can indicate that machine 10 has stopped the cleaning process because of a detected or sensed condition, and a red light can indicate that machine 10 is malfunctioning or has stopped operating. Other types of indicators can also be used to convey information to close-by people, such as digital text displays or audio alarms from a loudspeaker, such as voice prompts and horn sounds. Status light system 16 can be connected to control panel 18 to receive information from sensors in machine 10 to provide predictive turning information to bystanders. For example, if an object is sensed in the path of machine 10 and control panel 18 calculates that the path of machine 10 needs to be rerouted, status light system 16 can be used to provide information to a bystander that machine 10 will be changing path.

While machine 10 is in a robot or autonomous operating mode, it can be desirable to monitor and facilitate the driving and cleaning operations being executed by the various systems of machine 10. During user operation of machine 10, an operator drives machine 10 to maintain the cleaning path and avoid colliding with stationary and moving objects that are or can potentially become in the driving path of machine 10. Likewise, during user operation of machine 10, an operator is present to utilize sensory input to monitor the cleaning process, such as by watching for small objects in the cleaning path or observing torn squeegees or failing scrub pads. However, during autonomous operation, machine 10 can include various sensing and monitoring equipment as well as various supplementary cleaning equipment to ensure machine 10 autonomously drives in a safe manner and to ensure the cleaning operation continues in a proper and efficient manner. Machine 10 can include remote device 33 that can be carried by a remote operator of machine 10 to receive updates on the operation of machine 10 from communication link 41 of control panel 18, or directly from a sensor, or to provide command instructions to control panel 18 or machine 10. For example, remote device 33 can comprise fob 42 that can communicate with control panel 18 via a wireless connection using communication link 41 to convey information via indicators 44A, 44B and 44C or provide instructions via button 45.

In an example, trailing mop system 22 can be used to absorb residual moisture left behind by squeegee 32, if any. Trailing mop system 22 can include frame member 82 (FIG. 4) that is connected to chassis 24 of platform 20 via mounting system 85 (FIGS. 2 and 5), which can include a bracket mechanism or a motor. Squeegee 32 may become compromised such that dirty water from scrubber 30 is not properly transferred to the recovery system by squeegee 32. As such, in the case of autonomous operation of machine 10, it might not become noticed by an operator not at the site of machine 10 that liquid is being left behind. As such trailing mop system 22 can be used to absorb undesirable liquid trailing behind machine 10 during operation. Furthermore, trailing mop system 22 can include a sensor (e.g., sensor 48 of FIGS. 3 and 4) that can alert machine 10 or an operator having remote device 33 in electronic communication with machine 10 of the presence of liquid in trailing mop system 22. Likewise, forward mop system 23, which can be used for pre-sweeping operations, can also be provided with a moisture detection system as described herein, such as sensor 48 and brush 110. As such, a remote operator of machine 10 can be alerted to the possible compromise of a squeegee blade (e.g. blade 66 of FIG. 4) in squeegee 32, or entry of machine 10 into an area where there is water present on the floor and should not be.

As will be discussed in greater detail with reference to FIGS. 3-9, machine 10 can be outfitted with a variety of different instruments, systems, sensors and devices to enable and improve the autonomous operation of machine 10. Examples of machine 10 described herein can improve the efficiency of the cleaning or treating operation such as by reducing or eliminating deficient cleaning procedures and executing a consistent cleaning or treating operation, free of variability that can be introduced from procedure imperfections or operator error or variability.

Figure 3:
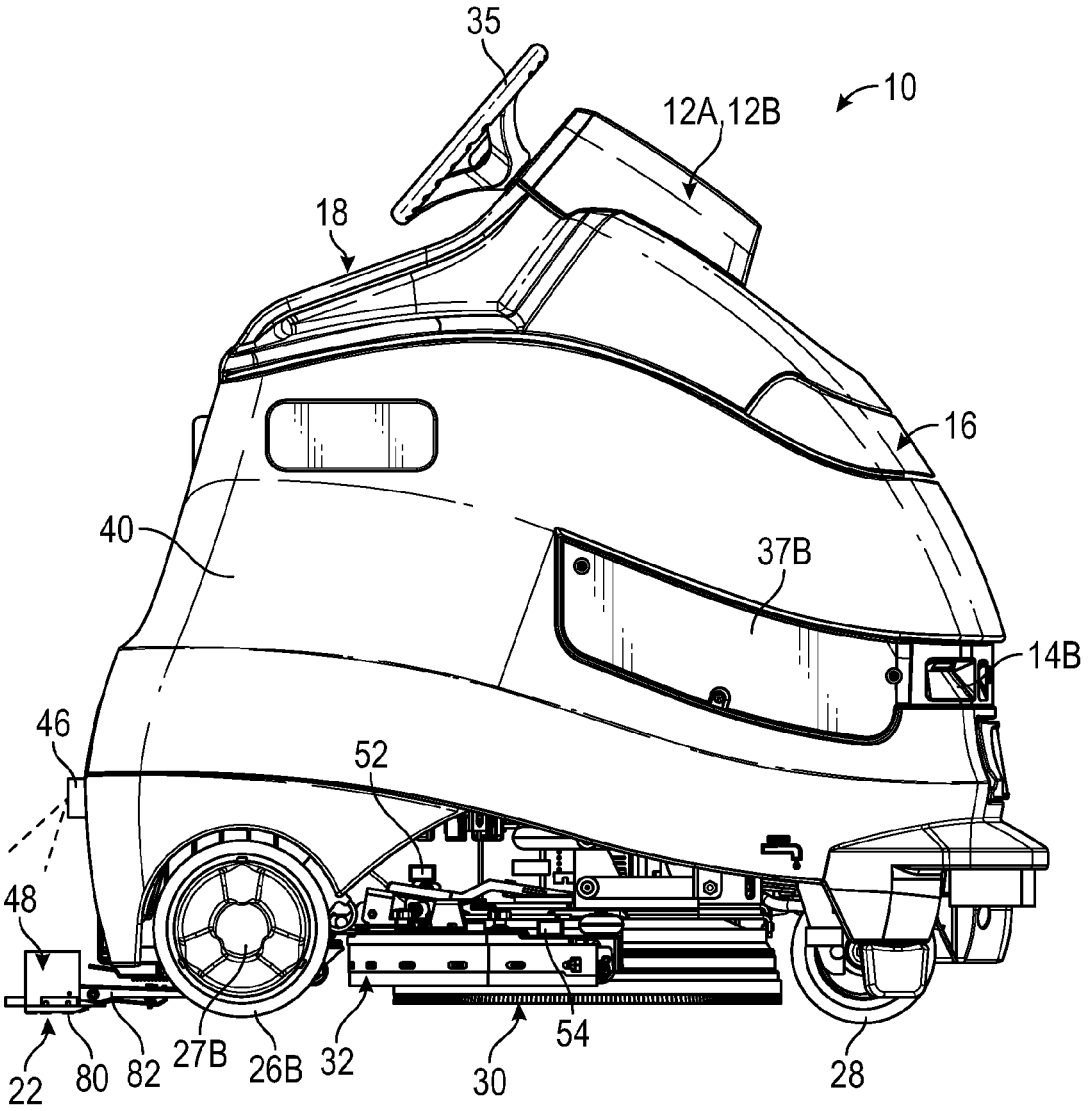
FIG. 3 is a side view of the robotic floor cleaning machine of FIGS. 1 and 2 showing the trailing mop system including a frame, an absorbent material and a sensor.

FIG. 3 is a side view of floor cleaning machine 10 of FIGS. 1 and 2 showing various sensors and cleaning devices that can be used to automate operation and cleaning of floor cleaning machine 10. FIG. 4 is an exploded view of floor cleaning machine 10 of FIG. 3 showing the location of the various sensors and cleaning devices of FIG. 3.

Machine 10 can include various supplementary cleaning devices, such as trailing mop system 22 and forward mop system 23. Machine 10 can also include various hardware and sensors to facilitate and monitor the cleaning and driving operations of machine 10, such as camera 46, moisture sensor 48, current sensor 50, pressure sensor 52, and sound sensor 54.

During a cleaning operation of machine 10, motor 56 of a propulsion system can be actuated to roll wheel 28 along the floor surface to be cleaned. While machine 10 is rolling on wheels 26A, 26B and 28, motor 58 of scrubber 30 can be activated to rotate scrubbing pad 60.

Cleaning solution or liquid can be added to a storage space within main cowling 40 through cap 62. Cleaning solution or liquid can be dispensed from within main cowling 40 to the area of scrubbing pad 60 via an actuator valve or nozzle system (not shown), preferably to an area forward of scrubbing pad 60 or on top of scrubbing pad 60. Suction hose 64 can be connected to squeegee 32 to vacuum up dirty cleaning solution behind scrubbing pad 60 and in front of the squeegee blade 66. Vacuum motor 68 draws the dirty cleaning solution into tank 70. Vacuum motor 68 can also be used to pump dirty cleaning solution out of tank 70 via hose 72. Motors 56, 58 and 68 can receive power from battery 74. Control panel 18 can include electronics that can be used to operate motors 56, 58 and 68. The electronics of control panel 18 can also be used to operate various sensors and devices on machine 10 to ensure that the dispensing system, scrubber 30, squeegee 32 and the recovery system are functioning correctly and performing a proper cleaning operation.

Machine 10 can include various sensors or devices for detecting whether or not various cleaning instruments, components, sensors or other devices are performing as desired within to machine 10. In particular, various sensors can be used to detect different conditions that can provide an indication of the performance of the recovery system.

For example, machine 10 can include current sensor 50. Current sensor 50 can be configured to monitor current flow in motor 68, which is used to control the amount of vacuum or suction generated in hose 64. A change in the sensed current can indicate that debris is lodged under squeegee blade 66 or that squeegee blade 66 is compromised, or sonic other condition. If the current level goes down, this can be an indication that that there is a leak, as motor 68 will need to draw less current and work less hard to provide suction. If the current level goes up, this can be an indication that there is a blockage of suction hose 72, as motor 68 will need to draw more current to work harder in an attempt to overcome the blockage. Current sensor 50 can comprise any suitable sensor as is known in the art. In an example, current sensor 50 can be configured to detect alternating current (AC) or direct current (DC) in a wire, and generate a signal proportional to the detected current. Examples of current sensors include Hall effect integrated circuit sensors, transformer or current clamp meters, fluxgate transformer type sensors, resistors, and fiber optic current sensors.

In the illustrated example, current sensor 50 can be located on a non-moving component of motor 68, such as housing 76, or in close proximity to motor 68. Alternatively, current sensor 50 can be included in electronics within control panel 18. Current sensor 50 can be in electronic communication with control panel 18 and can send a signal to electronics within control panel 18 based on the monitored magnitude of the sensed current running to and/or from motor 68. If control panel 18 receives an indication that the current of motor 68 has changed from a typical steady-state operation current level, which can indicate that squeegee blade 66 has developed a leak or has become otherwise breached during the cleaning operation, control panel 18 can send a wireless signal to remote device 33 to notify a remote operator of machine 10, or can provide an indication of the sensed condition at display 34. Additionally, control panel 18 can stop operation of one or both of scrubber 30 and machine 10.

Additionally, machine 10 can include pressure sensor 52. Pressure sensor 52 can be configured to monitor suction in front of squeegee blade 66, such as at inlet port 77. A change in the sensed vacuum can indicate that debris is blocking inlet port 77 to suction hose 64, or some other condition. Depending on where a leak or blockage occurs, a rise or fall in the suction level can be an indication that that there is a leak or a blockage. Pressure sensor 52 can comprise any suitable sensor as is known in the art. In an example, pressure sensor 52 can be configured to detect absolute, differential, gage, and vacuum pressure, and generate a signal proportional to the detected pressure or vacuum.

Pressure sensor 52 can be located on a frame member of squeegee 32, such as squeegee cover 78, in close proximity to blade 66. In the illustrated example, pressure sensor 52 can also be mounted directly to hose 64, such as near where hose 64 couples to inlet port 77. Pressure sensor 52 can be in electronic communication with control panel 18 and can send a signal to electronics within control panel 18 if a change in the vacuum level is detected. If control panel 18 receives an indication that the suction level of motor 68 went down from a typical steady-state operation suction level, which can indicate that squeegee blade 66 has developed a leak or has become otherwise breached during the cleaning operation, control panel 18 can send a wireless signal to remote device 33 to notify a remote operator of machine 10, or can provide an indication of the sensed condition at display 34. Additionally, control panel 18 can stop operation of one or both of squeegee 32 and machine 10.

Additionally, machine 10 can include sound sensor 54. Sound sensor 54 can be configured to monitor auditory noises near squeegee blade 66. A change in the sensed noise level can indicate that debris is blocking inlet port 77 to suction hose 64, or some other condition. Depending on where a leak or a blockage occurs, a rise or fall in the pitch of the sound can be an indication that that there is a leak or a blockage. Sound sensor 54 can comprise any suitable sensor as is known in the art, such as a microphone. In an example, sound sensor 54 can be configured to detect vibration or acoustic waves, and generate a signal proportional to the detected sound wave.

In the illustrated example, sound sensor 54 can be located on a frame member of squeegee 32, such as squeegee cover 78, in close proximity to blade 66. Sound sensor 54 can also be mounted directly to hose 64, such as near where hose 64 couples to inlet port 77. Sound sensor 54 can be in electronic communication with electronics within control panel 18 and can send a signal to control panel 18 if a change in the volume or pitch of the sensed sound is detected. If control panel 18 receives an indication that the sound level of motor 68 went down from a typical steady state operation suction level, which can indicate that squeegee blade 66 has developed a leak or has become otherwise breached during the cleaning operation, control panel 18 can send a wireless signal to remote device 33 to notify a remote operator of machine 10, or can provide an indication of the sensed condition at display 34. Additionally, control panel 18 can stop operation of one or both of squeegee 32 and machine 10.

Machine 10 can include camera 46 (FIGS. 2 & 3), which can be configured to provide a plurality of different inputs to control panel 18. In an example, camera 46 comprises a rear-facing optical camera that can capture a visible spectrum image of the floor behind squeegee 32 or machine 10. The visible spectrum image can be sent to control panel 18, which can forward the image to a remote operator for viewing, such as by using remote device 33, or can be shown on display 34. Additionally, the image can be sent, for example, as a text message to a cell phone at periodic intervals, or can be available as a live stream for continuous monitoring. Other types of images, such as infrared (IR) or ultraviolet (UV), can also be captured and sent to a remote operator. In another example, camera 46 can be configured to monitor the floor with spectroscopy. A spectroscope can be configured to shine near-infrared light onto the floor. By analyzing the light that is reflected back to camera 46, unique optical signatures can be identified that indicate water on the floor. Additionally, the images and optical signatures can be compared to reference images and signals stored in a library or database stored in control panel 18 so that control panel 18 can conduct an automated comparison of the data obtained from the live cleaning process to reference data taken from a reference cleaning operation where the cleaning operation is occurring as intended, e.g., without any, or any significant, water trailing.

In another example, camera 46 can comprise a thermal imaging device to detect differences in temperature behind machine 10. Water left behind by squeegee 32 can be indicated by cooler temperatures. Water left behind by squeegee blade 66 that has become compromised or cut, or large debris stuck under blade 66 can appear as a streak on the thermal image.

Some monitoring techniques, including but not limited to IR, UV, polarization, and spectroscopy, can be used to produce an electronic image, which can be stored in memory of control panel 18. The detected image can be compared with a visible spectrum image stored in memory of control panel 18 in order to avoid false positive detections of trailed water from imperfections in the floor, or patterns in the floor that could be interpreted as streaks by one or the other type of image. In an example, it can be advantageous to "negative" (e.g., color inverse) the image in the visible spectrum to provide contrast for comparison with other electronic images. These techniques can be used to avoid false detection of tile grout lines, paint stripes, etc. as water trails.

In various examples, a tracing element can be mixed with the cleaning solution to enhance detection of trailed water. For example, an optical brightener which fluoresces in UV light can be added to the cleaning solution. A UV emitting device can project behind squeegee 32 and a detecting device (e.g., camera 46) can determine the level of fluorescing. Similarly, an agent that can be detected by an olfactory sensor can be added to the cleaning solution. Water trailing can be indicated when a predetermined level of detection is reached.

In examples of a water trail detection system, absorbent material 80 can be extended across the width of the cleaning path, across the width of squeegee 32, or across some other width, and can be positioned behind the path of squeegee 32 or behind platform 20, such as by using trailing mop system 22. In other examples, absorbent material 80 can extend across less than the entire cleaning path or width of squeegee 32. Materials suitable for absorbent material 80 can include, but is not limited to, absorbent foam, sponge, microfiber, cotton, wool, or a combination of materials. Absorbent material 80 can be mounted to a holder or frame member 82 behind squeegee 32 or behind platform 20. Absorbent material 80 can be in the form of a rectangular strip that extends approximately across the width of the cleaning path in one dimension, and absorbent material 80 can be between about 1 inch (~2.54 cm) to about 6 inches (~15.24 cm) in the other dimension. Absorbent material 80 can serve to wipe small amounts of trailed water. In an example, moisture sensor 48 can be in fluid communication with absorbent material 80 to indicate if the material reaches a predetermined moisture level, which may suggest that an unacceptable amount of water is trailing machine 10. Absorbent material 80 can also be in the form of a roller. Further description of the water trail detection system and trailing mop system 22 are provided with reference to FIGS. 5-8.

Figure 5A:
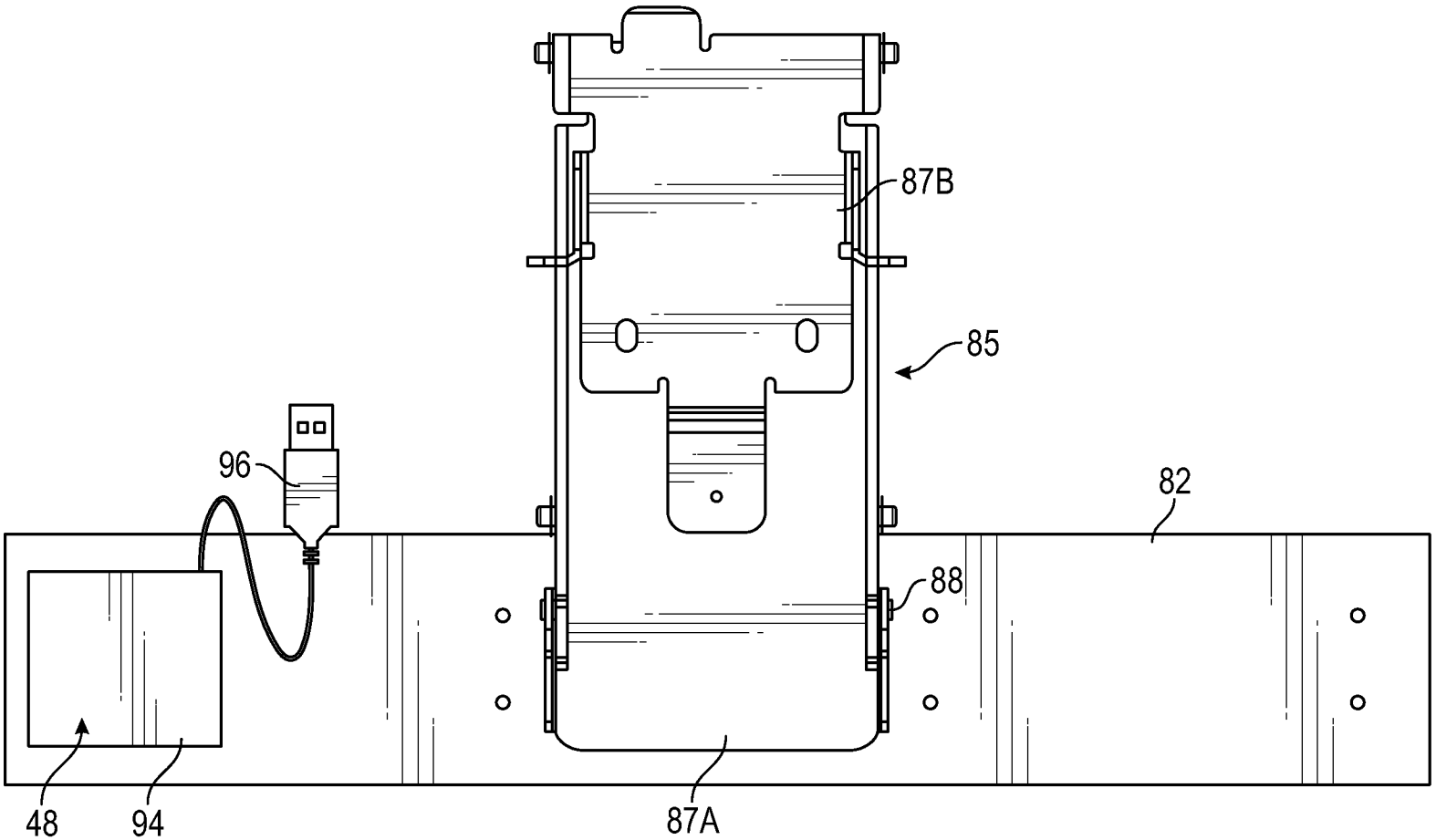
FIG. 5A is a top view of the trailing mop system of FIGS. 2-4 showing a close-up of the frame, the absorbent material and the sensor.
Figure 5B:
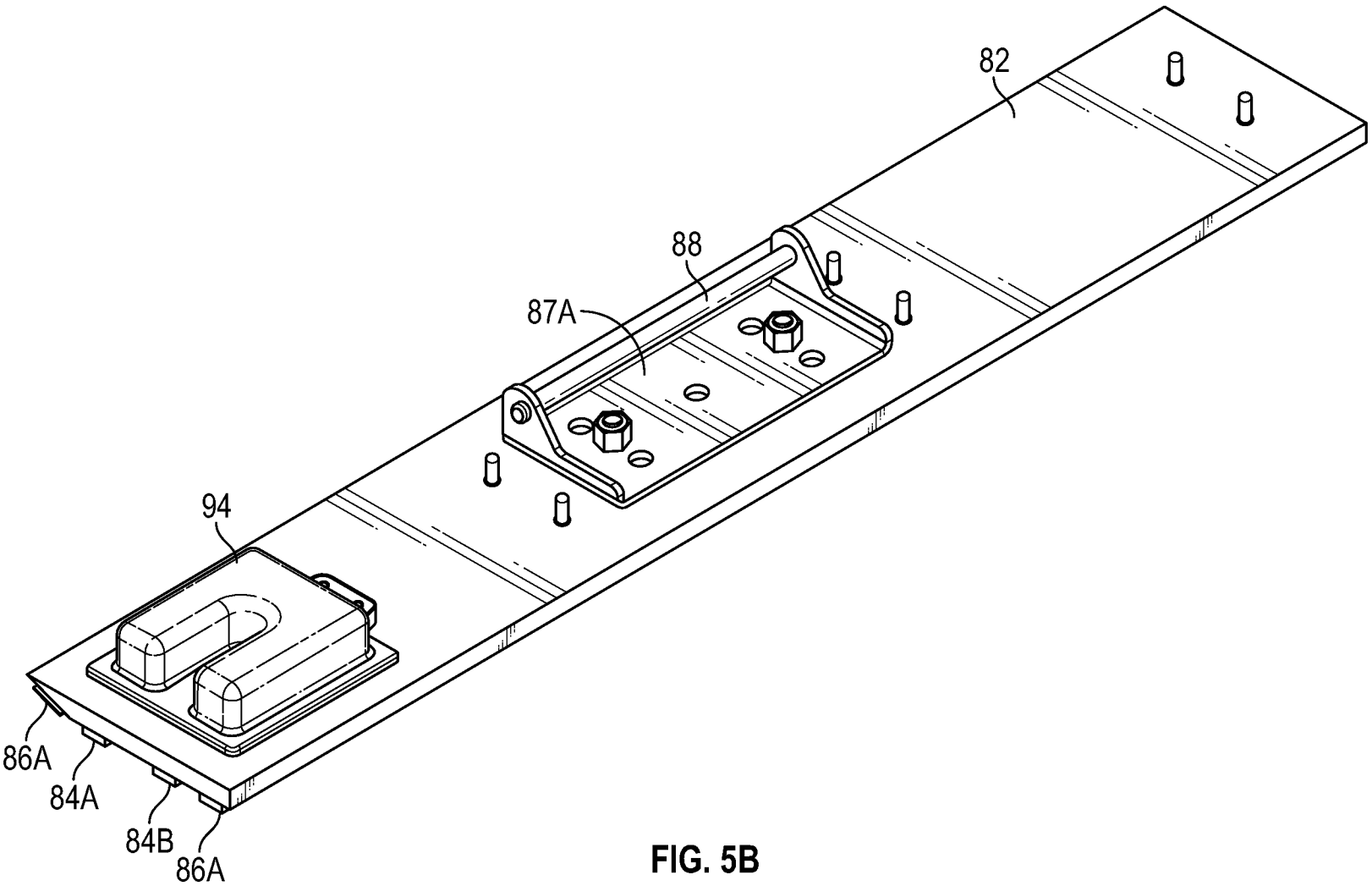
FIG. 5B is a top perspective view of the frame of FIG. 5A showing a portion of a mounting system for connecting the trailing mop system to a chassis of a floor cleaning machine.
Figure 6:
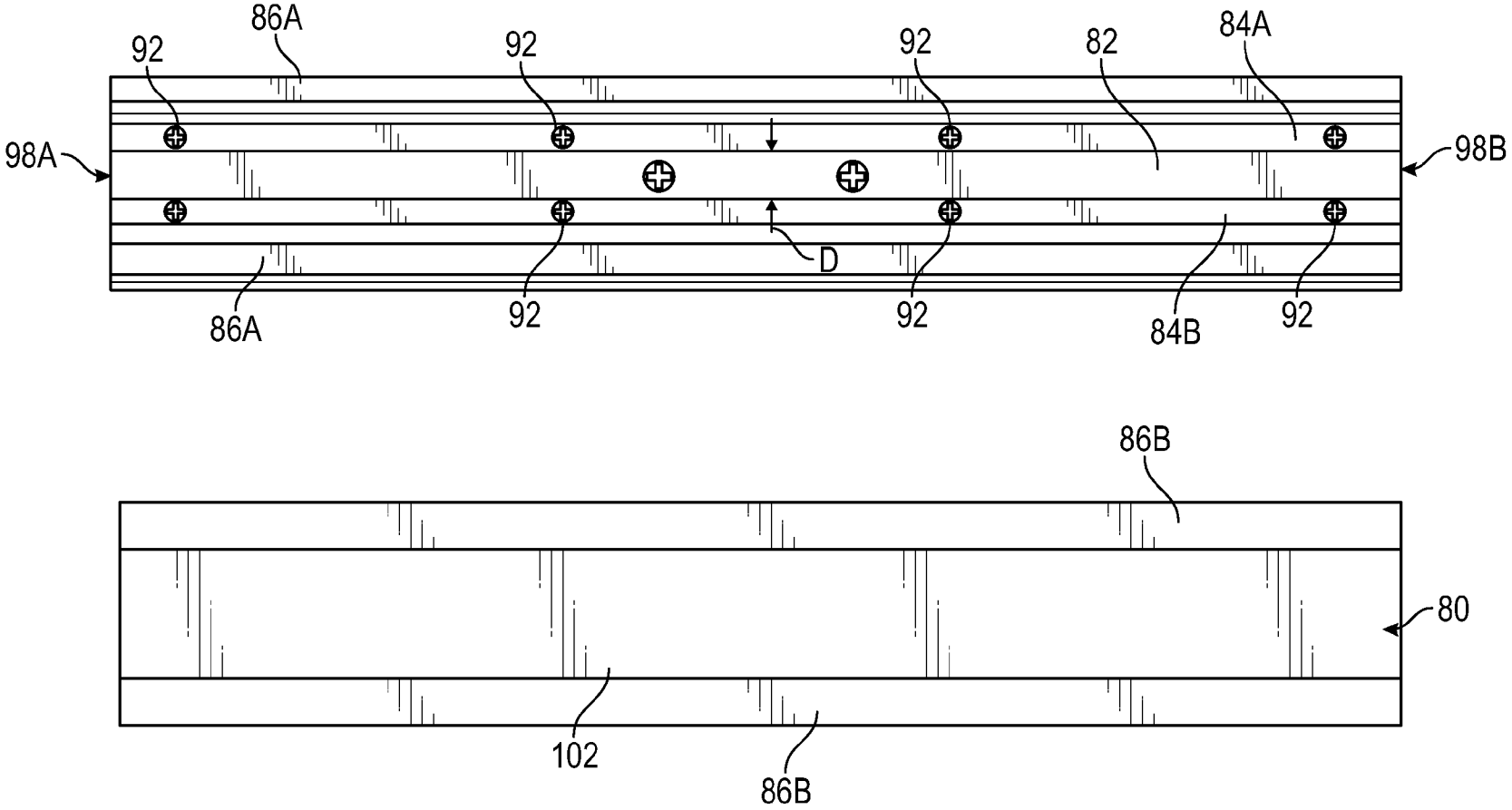
FIG. 6 is a bottom view of the frame of FIG. 5A and a top view of the absorbent material or FIG. 5A removed from the frame to show a pair of electrode strips mounted to the frame.

FIG. 5A is a top perspective view of trailing mop system 22 of FIGS. 2-5 showing a close-up of frame member 82, absorbent material 80 and sensor 48. FIG. 5B is a top perspective view of frame member 82 of FIG. 5A showing a portion of mounting system 85 for connecting trailing mop system 22 to chassis 24 of machine 10. FIG. 6 is a bottom view of frame member 82 of FIG. 5A and a top view of absorbent material 80 of FIG. 5A removed from frame member 82 to show first and second electrode strips 84A and 84B mounted to frame member 82. Frame member 82 can be connected to machine 10 using mounting system 85. Absorbent material 80 can be connected to frame member 82 using any suitable fastening methods, such as threaded fasteners, adhesive, or hook and loop fastener material strips 86A and 86B.

Frame member 82 can have a width at least as wide as scrubber 30 or squeegee 32, but can be less than the width of scrubber 30 or squeegee 32. However, frame member 82 can be as wide as the width of machine 10 or the distance between wheels 26A and 26B. Trailing mop system 22 and frame member 82 can be mounted to chassis 24 in any suitable manner, either in a fixed manner or an adjustable manner, such as by using mounting system 85. Mounting system 85 can include, brackets 87A and 87B and pin 88. For example, frame member 82 can be connected to bracket 87A haying pin 88, which can couple to bracket 87B connected to chassis 24 or platform 20. Bracket 87B can be configured to receive pin 88 in a pivoting manner. Bracket 87B can be configured to raise and lower relative to chassis 24, such as via a spring system or via foot pedal-operated system. Trailing mop system 22 can be connected to a motor mechanism (not shown) and can be raised and lowered automatically by a user-initiated input at control panel 18. In other examples, trailing mop system 22 can be raised or lowered manually, or added and removed from chassis 24 manually. Weights (not shown) can be mounted to frame member 82 to facilitate contact between absorbent material 80 and the floor. Additionally, mounting system 85 can include springs (not shown) to maintain frame member 82 biased in either an upward position or a downward position.

Sensor 48 can include electrodes 84A and 84B, housing 94, cable 96, and electronics, which may be located within housing 94 or in electronics of control panel 18. Sensor 48 can be provided on or in trailing mop system 22 to determine a moisture level in the cleaning medium or absorbent material 80. Electrodes 84A and 84B can be mounted to frame member 82 or can be embedded within absorbent material 80. Sensor 48 can be configured as a moisture-indicating sensor, such as by including electrodes 84A and 84B having a conductivity or capacitance that changes as more or less water is present between electrodes 84A and 84B. Thus, sensor 48 can comprise a conductivity sensor that provides an indication of moisture. In the illustrated embodiment, electrodes 84A and 84B are positioned between frame member 82 and absorbent material 80. In particular, electrodes 84A and 84B can be mounted to frame member 82, such as by using fasteners 92. Wires can extend from electrodes 84A and 84B through frame member 82 to extend into housing 94, which can be connected to control panel 18 via cable 96. Electronics for operating sensor 48 can be located within housing 94 or within control panel 18. Electrodes 84A and 84B extend all the way across the width of frame member 82 from first end 98A to second end 98B.

Absorbent material 80 is mounted to frame member 82 to span distance D between electrodes 84A and 84B. Absorbent material 80 additionally extends the width of frame member 82 from first end 98A to second end 98B. If absorbent material 80 is dry, sensor 48 can generate a baseline signal representative of the sensed conductivity or capacitance between electrodes 84A and 84B. If absorbent material 80 begins to accumulate moisture, e.g., water or cleaning solution, the signal generated by sensor 48 will deviate from the baseline signal. Sensor 48 can have a sensitivity level configured to indicate if squeegee 32 is trailing excessive water, which can be an indication of a detached or compromised squeegee blade 66. For example, sensor 48 can send a moisture indicator signal to control panel 18 and control panel 18 can be programmed to trigger an alarm (e.g., on remote device 33 or display 34) for an operator of machine 10 at a threshold that would be above incidental moisture left behind by squeegee 32.

Figure 7:
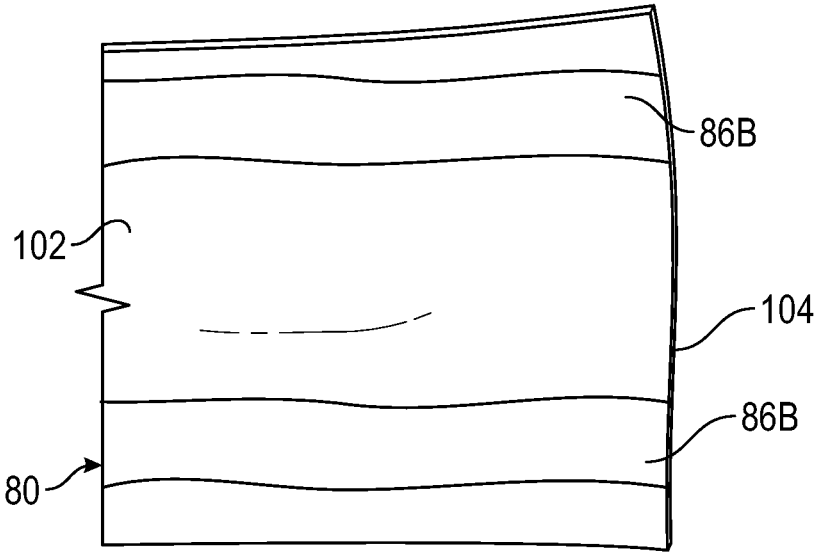
FIG. 7 is a close-up partial top view of the absorbent material of FIG. 6 showing connection strips for coupling to the frame.
Figure 8:
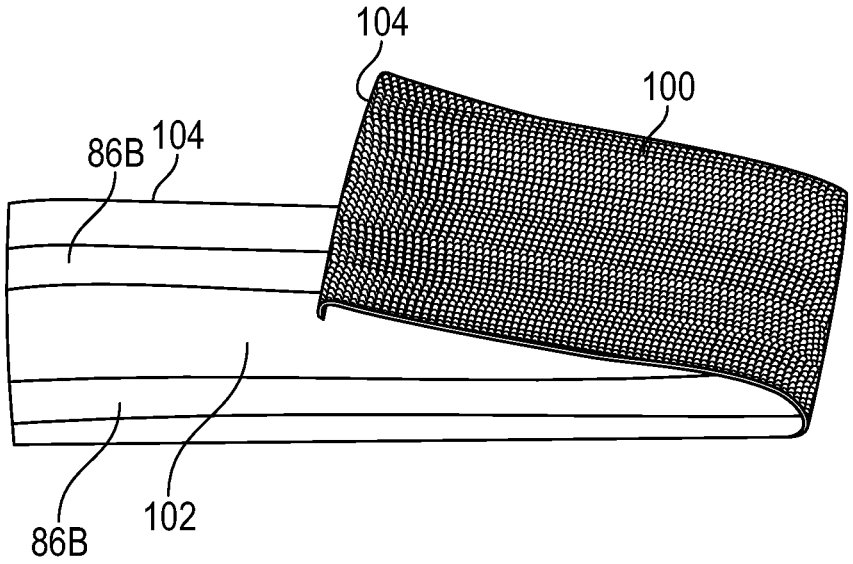
FIG. 8 is a close-up partial bottom view of the absorbent material of FIG. 6 showing absorbent fibers for drawing moisture to the pair of electrode strips of FIG. 6.

FIG. 7 is a close-up partial top view of absorbent material 80 of FIG. 6 showing connection strips 86B for coupling to connection strips 86A on frame member 82. FIG. 8 is a close-up partial bottom view of absorbent material 80 of FIG. 6 showing absorbent fibers 100 for drawing moisture to electrodes 84A and 84B of FIG. 6. As discussed above, trailing mop system 22 can be used as a redundant recovery system for squeegee 32. Thus, trailing mop system 22 can include absorbent material 80 that can contact the floor behind blade 66 of squeegee 32 to wipe or pick up any water or fluid that may be left behind.

Absorbent material 80 can include absorbent fibers 100 and backing 102, which can be connected by edge seam 104. Connection strips 86A can be connected to backing 102 by any suitable method, such as stitching, adhesive or the like. Backing 102 can comprise any compliant material, such as cloth or the like. Absorbent fibers 100 can comprise any suitable cleaning medium such, as chamois, sponge, microfiber, or other absorbent material. Connection strips 86A can extend parallel to electrodes 84A and 84B.

Connection strips 86A can be positioned to hold absorbent material 80 flat between electrodes 84A and 84B so that a consistent pathway between electrodes 84A and 84B can be produced. In other examples, electrodes 84A and 84B can be attached to backing 102 in such a manner that the material of backing 102 is evenly distributed, or flat, between electrodes 84A and 84B. Electrodes 84A and 84B can be attached to backing 102 on the exterior of absorbent material 80 or can be positioned between backing 102 and absorbent fibers 100 in the interior of absorbent material 80. In examples, the fabric, cloth or textile of absorbent material 80 can be positioned between electrodes 84A and 84B in a forward to aft direction to form a conductive path in between electrodes 84A and 84B that can influence the conductivity or capacitance therebetween, preferably in a uniform and consistent manner.

Figure 9:
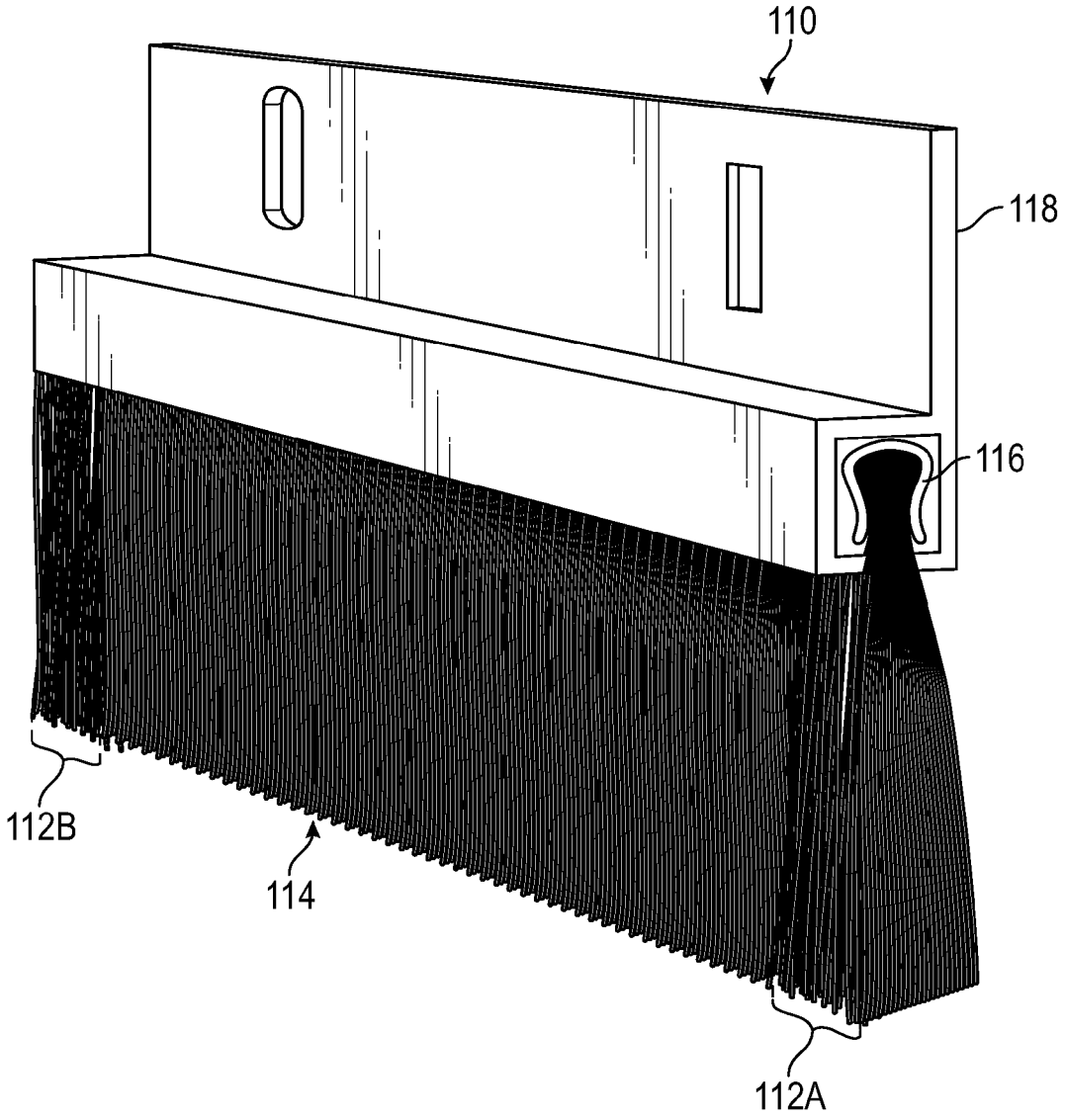
FIG. 9 is a perspective view of an alternative embodiment of a water trailing detection system comprising a brush having conductive bristles.

FIG. 9 is a perspective view of an alternative embodiment of water trailing detection system 22 comprising brush 110 having conductive bristle zones 112A and 112B. In an example, brush 110 can also include non-conductive bristles 114 so as to form a bristle strip. Bristles of conductive bristle zones 112A and 112B can be used as electrodes to sense moisture, cleaning solution or water on a floor on which machine 10 is performing a cleaning operation.

Conductive bristle zones 112A and 112B and non-conductive bristles 114 can be connected to frame 116, which can include bracket 118. Frame 116 can comprise a rigid or semi-rigid structure that can hold bristles of conductive bristle zones 112A and 112B and non-conductive bristles 114 into contact with a floor. Frame 116 can be as wide as squeegee 32, scrubber 30 or the width between wheels 26A and 26B, or wider. Frame 116 can be coupled to machine 10 in various locations using various methods. For example, frame 116 can be mounted to squeegee 32 on the trailing side of blade 66, on chassis 24 behind squeegee 32, or on chassis 24 (or platform 20) behind machine 10. In other embodiments, non-conductive bristles 114 can be omitted from brush 110 so that only conductive bristles are included. As such, bristles of conducive bristle zones 112A and 112B can be used only to perform moisture or water trailing sensing without sweeping action. In an example, non-conductive bristles 114 can be replaced with a squeegee blade, such as blade 66.

Bracket 118 can be coupled to machine 10 by any suitable method, such as fasteners, welding, hooks and the like. In an example, bracket 118 can be coupled to bracket 87B of mounting system 85 (FIG. 2). As such, frame 116 can be manually adjustable or removable, or can be automatically adjustable with a motor so as to be put into contact with a floor and removed from contact with the floor.

Bristles of conductive bristle zones 112A and 112B can be connected to control panel 18 via any suitable methods, such as wires, so that those bristles can become electrodes. All of the bristles in each zone can be connected to each other so as to form one single large electrode zone, or each bristle, or a sub-set of bristles, can form an electrode. The illustrated example shows two conductive bristle zones, but more can be spread out across frame 116 to sense moisture in specific zones across the width of the cleaning path.

Control panel 18 can be configured to detect the conductivity or capacitance between various electrodes of brush 110. If the floor between the electrodes of brush 110 is dry, the electrodes can generate a baseline signal, or multiple signals for different zones of electrodes, representative of the sensed conductivity or capacitance between the electrodes. If the bristles begin to come in contact with moisture, e.g., water or cleaning solution, the signal generated by brush 110 will deviate from the baseline signal. Conductive bristle zones 112A and 112B can have a sensitivity level configured to indicate if squeegee 32 is trailing excessive water, which can be an indication of a detached or compromised squeegee blade 66. For example, bristle zones 112A and 112B can send a moisture signal to control panel 18 and control panel 18 can be programmed to trigger an alarm (e.g., on remote device 33 or display 34) for an operator of machine 10 at a threshold that would be above incidental moisture left behind by squeegee 32.

Data from any of the aforementioned monitoring methods can be analyzed by a processor within control panel 18, or located remotely from machine 10 and in communication with control panel 18 via a wired or wireless communication link 41, to determine if the changes meet a threshold indicating that water was left behind by squeegee 32. The data can be shown in various formats to an operator of machine 10 via a plurality of different methods, such as graphically at display 34 or via indicators at remote device 33. Control panel 18 can be configured to operate the various sub-systems, components, sensors and devices of machine 18 from a single location where an operator can stand on platform 20. Control panel 18 therefore can include various hardware and software components for operating machine 10. For example, control panel 18 can include user interface devices, processors, memory and the like for receiving input from various items, such a signals from camera 46, sensors 48, 50, 52 and 54, and providing output to various items, such as fob 42, display 34 and motors 56, 58 and 68. Control panel 18 can include various forms of electronic memory for storing the various libraries and databases described herein, as well as programming for executing various cleaning instructions and commands, as described herein. In an example, control panel 18 can be implemented as a portable computing device such as a tablet computer.

Control panel 18 can include a wireless hub, such as wireless communication link 41, that permits control panel 18 to communicate with devices external to machine 10. Communication link 88 allows control panel 18 to access data and control other devices or autonomous machines. In one example, wireless communication link 41 communicates with a wireless local area network that permits communication with a local database or server at the location of machine 10 (e.g., within the same facility). In another example, wireless communication link 41 can be a Bluetooth communication device, In another example, wireless communication link 41 is able to connect to the Internet via various public or private signals, such as cellular or 4G networks and the like. Likewise, wireless communication link 41 can be configured to communicate directly with remote device 33 and fob 42, or indirectly, such as through a network or Internet connection.

Also, if a moist or wet area is detected to the rear of machine 10, control panel 18 can take corrective action in a reactive manner. If control panel 18 detects a moist or wet area behind of machine 10, control panel 18 can adjust the cleaning operation to be performed by scrubber 30, squeegee 32 or a liquid system. For example, in order to potentially rectify the water trailing detected by moisture sensor 48, control panel 18 can increase or decrease the force with which squeegee 32 is pushed against the floor, increase or decrease the suction generated by motor 68, increase or decrease the quantity of liquid from the liquid system, or can adjust the speed of machine 10. In an example, blade 66 of squeegee 32 can be lifted off the floor and then dropped back onto the floor in an attempt to free or liberate any debris lodged between blade 66 and the floor. Similarly, in an example, debris can be removed from blade 66 by propelling machine 10 in reverse for a short distance, raising squeegee 32 a slight distance from the floor, or a combination of driving in reverse and raising squeegee 32, to allow the debris to be loosened and carried into the vacuum recovery system. In an autonomous mode, corrective measures can be taken at timed intervals or at designated locations in order to preemptively reduce the occurrence of water trailing.

The autonomous or robotic and manual floor cleaning equipment described herein provide advantages over other autonomous and manual systems. More efficient autonomous operation provided by the systems and methods described herein can reduce labor costs by allowing an operator of an autonomous cleaning machine to perform other tasks while the autonomous machine operates. Additionally, the cleaning operations can be more consistently or systematically performed, such that spots are not missed or cleaning is duplicated, thereby reducing or eliminating rework. Autonomous machines can also be programmed to concentrate on high-use or particularly dirty areas rather than manual operators that tend to clean all areas equally, including those that have not been dirtied. Autonomous cleaning system are particularly advantageous for use in large open areas where the cleaning operation involves long intervals of repeated, back-and-forth operations. The systems and methods described herein facilitate and improve autonomous navigation and autonomous cleaning operations to expand the advantageous use of autonomous cleaning machines to other spaces that are not as simply cleaned as open areas. For example, systems and methods described herein allow the autonomous cleaning machine to be used in tight spaces that may utilize unique, non-repetitive route instructions or in spaces where pedestrian traffic might be present and where water trailing might frequently arise. The systems and methods of autonomous navigation and cleaning described herein can also reduce cleaning time of autonomous machines be reducing the amount of time the autonomous machine may be performing an ineffective cleaning operation, such as when a cleaning pad or squeegee blade fails.

Various Notes & Examples

Example 1 can include or use subject matter (such as a floor cleaning machine comprising: a chassis configured to move along a cleaning path; a cleaning mechanism connected to the chassis to perform a cleaning operation; a liquid system connected to the chassis to provide liquid to the cleaning mechanism; a recovery system connected to the chassis to recover liquid from the cleaning operation; a control system connected to the floor cleaning machine to control performance of the cleaning operation; and a cleaning operation sensing system connected to the control system to detect a condition of the cleaning operation.

Example 2 can include, or can optionally be combined with the subject matter of Example 1, to optionally include a cleaning operation sensing system that can include a moisture sensor configured to detect moisture from the cleaning operation.

Example 3 can include, or can optionally be combined with the subject matter of one or any combination of Examples 1 or 2 to optionally include a moisture sensor that can comprises: a first electrode; and a second electrode spaced from the first electrode; wherein the first and second electrodes are disposed in close proximity to the cleaning path and are configured to sense the liquid from the cleaning operation.

Example 4 can include, or can optionally be combined with the subject matter of one or any combination of Examples 1 through 3 to optionally include first and second electrodes that are mounted to the frame to extend lengthwise across at least a portion of the cleaning path.

Example 5 can include, or can optionally be combined with the subject matter of one or any combination of Examples 1 through 4 to optionally include a first electrode and a second electrode that can be connected to a mounting system that is adjustable to raise and lower the first electrode and the second electrode.

Example 6 can include, or can optionally be combined with the subject matter of one or any combination of Examples 1 through 5 to optionally include a cleaning operation sensing system that can include a trailing mop system mounted to the floor cleaning machine along the cleaning path at a rear of the floor cleaning machine, wherein the moisture sensor is mounted to the trailing mop system.

Example 7 can include, or can optionally be combined with the subject matter of one or any combination of Examples 1 through 6 to optionally include a trailing mop system that can comprise: a frame connected to the chassis; and an absorbent medium mounted to the frame to contact the first electrode and the second electrode and positioned to contact the cleaning path and absorb moisture.

Example 8 can include, or can optionally be combined with the subject matter of one or any combination of Examples 1 through 7 to optionally include a moisture sensor that can comprise: a first conductive bristle defining the first electrode; and a second conductive bristle defining the second electrode.

Example 9 can include, or can optionally be combined with the subject matter of one or any combination of Examples 1 through 8 to optionally include a first conductive bristle that can be part of a first cluster of bristles; and a second conductive bristle that can be part of a second cluster of bristles spaced from the first cluster of bristles.

Example 10 can include, or can optionally be combined with the subject matter of one or any combination of Examples 1 through 9 to optionally include a recovery system that can further comprise a squeegee blade and the first and second clusters of bristles are positioned on a trailing side of the squeegee blade.

Example 11 can include, or can optionally be combined with the subject matter of one or any combination of Examples 1 through 10 to optionally include an absorbent pad connected to the chassis to contact the cleaning path and absorb moisture, wherein the recovery system further comprises a suction motor and the cleaning operation sensing system comprises a current sensor configured to sense current flow through the suction motor.

Example 12 can include, or can optionally be combined with the subject matter of one or any combination of Examples 1 through 12 to optionally include a recovery system that can further comprise a suction motor and the cleaning operation sensing system comprises a pressure sensor configured to sense suction generated by the suction motor.

Example 13 can include, or can optionally be combined with the subject matter of one or any combination of Examples 1 through 12 to optionally include a recovery system that can further comprise a squeegee blade and the cleaning operation sensing system comprises a sound sensor connected to the chassis proximate the blade.

Example 14 can include, or can optionally be combined with the subject matter of one or any combination of Examples 1 through 13 to optionally include a cleaning operation sensing system that can comprise a camera connected to the floor cleaning machine and configured to view the cleaning path behind the recovery system.

Example 15 can include, or can optionally be combined with the subject matter of one or any combination of Examples 1 through 14 to optionally include a camera that can comprise a thermal imaging camera.

Example 16 can include, or can optionally be combined with the subject matter of one or any combination of Examples 1 through 15 to optionally include a liquid system that can include a liquid cleaning solution and a tracing element added to the liquid cleaning solution visible by the camera.

Example 17 can include or use subject matter such as a moisture detection system for a floor cleaning machine configured to drive along a cleaning path comprising: a frame for connecting to a cleaning machine; electrodes connected to the frame for engaging moisture along the cleaning path; and a sensor electronics system connected to the electrodes to determine presence of moisture at the electrodes.

Example 18 can include, or can optionally be combined with the subject matter of Example 17, to optionally include an absorbent medium connected to the frame, wherein the electrodes comprise first and second electrode strips extending across at least a portion of a width of the frame in contact with the absorbent medium, and wherein the sensor electronics system is configured to detect conductivity in the absorbent medium between the first and second electrodes.

Example 19 can include, or can optionally be combined with the subject matter of one or any combination of Examples 17 or 18 to optionally include electrodes that can comprise a plurality of bristles extending from the frame, and wherein the sensor electronics system is configured to detect conductivity between sections of the plurality of bristles.

Example 20 can include or use subject matter such as a floor cleaning machine comprising: a chassis having a forward end and an aft end, the chassis configured to move along a cleaning path; a cleaning mechanism connected to the chassis to perform a cleaning operation; a liquid system connected to the chassis to provide liquid to the cleaning mechanism; a recovery system connected to the chassis aft of the cleaning mechanism to recover liquid from the cleaning operation; a control system connected to the floor cleaning machine to control performance of the cleaning operation; and a water trailing detection system comprising: a frame connected to the chassis aft of the recovery system; an absorbent medium connected to the frame; and a moisture sensor in communication with the control system and configured to generate a signal in response to moisture in the absorbent medium.

Example 21 can include, or can optionally be combined with the subject matter of Example 20, to optionally include a control system that can be configured to control autonomous movement of the chassis and autonomous performance of the cleaning operation, wherein the control system can adjust one or both of the autonomous movement of the chassis and the autonomous performance of the cleaning operation in response to receiving the signal.

Example 22 can include, or can optionally be combined with the subject matter of one or any combination of Examples 20 or 21 to optionally include a moisture sensor that can comprise: a first electrode extending across a first portion of a length of the cleaning path; and a second electrode extending across a second portion of the length of the cleaning path, the second electrode spaced aft of the first electrode on the frame adjacent the absorbent medium.

Each of these non-limiting examples can stand on its own, or can be combined in various permutations or combinations with one or more of the other examples.

The above detailed description includes references to the accompanying drawings, which form a part of the detailed description The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects. Additionally, use of the word "connected" need not imply or require that two components are directly connected to each other, but can include components connected by intermediary components.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. A floor cleaning machine comprising:

a chassis configured to move along a cleaning path;

a cleaning mechanism connected to the chassis to perform a cleaning operation;

a liquid system connected to the chassis to provide liquid to the cleaning mechanism;

a recovery system connected to the chassis to recover liquid from the cleaning operation;

a control system connected to the floor cleaning machine to control performance of the cleaning operation; and a cleaning operation sensing system connected to the control system and including a moisture sensor configured to detect moisture from the cleaning operation, the moisture sensor comprising a first conductive bristle defining a first electrode that is spaced from a second conductive bristle defining a second electrode, wherein the first and second electrodes are disposed in close proximity to the cleaning path and are configured to sense the liquid from the cleaning operation external to the floor cleaning machine.

2. The floor cleaning machine of claim 1, wherein the first and second electrodes are mounted to the frame to extend lengthwise across at least a portion of the cleaning path.

3. The floor cleaning machine of claim 1, wherein the first electrode and the second electrode are connected to a mounting system that is adjustable to raise and lower the first electrode and the second electrode.

4. The floor cleaning machine of claim 1, wherein:

the first conductive bristle is part of a first cluster of bristles; and the second conductive bristle is part of a second cluster of bristles spaced from the first cluster of bristles.

5. The floor cleaning machine of claim 4, wherein the recovery system further comprises a squeegee blade and the first and second clusters of bristles are positioned on a trailing side of the squeegee blade.

6. The floor cleaning machine of claim 1, further comprising an absorbent pad connected to the chassis to contact the cleaning path and absorb moisture, wherein the recovery system further comprises a suction motor and the cleaning operation sensing system comprises a current sensor configured to sense current flow through the suction motor.

7. The floor cleaning machine of claim 1, wherein the recovery system further comprises a suction motor and the cleaning operation sensing system comprises a pressure sensor configured to sense suction generated by the suction motor.

8. The floor cleaning machine of claim 1, wherein the recovery system further comprises a squeegee blade and the cleaning operation sensing system comprises a sound sensor connected to the chassis proximate the blade.

9. The floor cleaning machine of claim 1, wherein the cleaning operation sensing system comprises a camera connected to the floor cleaning machine and configured to view the cleaning path behind the recovery system.

10. The floor cleaning machine of claim 9, wherein the camera comprises a thermal imaging camera.

11. The floor cleaning machine of claim 9, wherein the liquid system includes a liquid cleaning solution and a tracing element added to the liquid cleaning solution visible by the camera.

12. A moisture detection system for a floor cleaning machine configured to drive along a cleaning path, the moisture detection system comprising:

a frame for connecting to a cleaning machine;

electrodes connected to the frame for engaging moisture along the cleaning path; and a sensor electronics system connected to the electrodes to determine presence of moisture at the electrodes;

wherein the electrodes comprise a plurality of bristles extending from the frame, and wherein the sensor electronics system is configured to detect conductivity between sections of the plurality of bristles.

13. A floor cleaning machine comprising:

a chassis having a forward end and an aft end, the chassis configured to move along a cleaning path;

a cleaning mechanism connected to the chassis to perform a cleaning operation;

a liquid system connected to the chassis to provide liquid to the cleaning mechanism;

a recovery system connected to the chassis aft of the cleaning mechanism to recover liquid from the cleaning operation;

a control system connected to the floor cleaning machine to control performance of the cleaning operation; and a water trailing detection system comprising:

a frame connected to the chassis aft of the recovery system;

an absorbent medium connected to the frame; and a moisture sensor in communication with the control system and configured to generate a signal in response to moisture in the absorbent medium.

14. The floor cleaning machine of claim 13, wherein the control system is configured to control autonomous movement of the chassis and autonomous performance of the cleaning operation, wherein the control system can adjust one or both of the autonomous movement of the chassis and the autonomous performance of the cleaning operation in response to receiving the signal.

15. The floor cleaning machine of claim 13, wherein the moisture sensor comprises:

a first electrode extending across a first portion of a length of the cleaning path; and a second electrode extending across a second portion of the length of the cleaning path; the second electrode spaced aft of the first electrode on the frame adjacent the absorbent medium.

16. A floor cleaning machine comprising:

a chassis configured to move along a cleaning path;

a cleaning mechanism connected to the chassis to perform a cleaning operation;

a liquid system connected to the chassis to provide liquid to the cleaning mechanism;

a recovery system connected to the chassis to recover liquid from the cleaning operation;

a control system connected to the floor cleaning machine to control performance of the cleaning operation; and a cleaning operation sensing system connected to the control system and including a moisture sensor configured to detect moisture from the cleaning operation, the moisture sensor comprising a first electrode and a second electrode spaced from the first electrode, the first and second electrodes disposed in close proximity to the cleaning path and configured to sense the liquid from the cleaning operation external to the floor cleaning machine, wherein the cleaning operation sensing system further includes a trailing mop system mounted to the floor cleaning machine along the cleaning path at a rear of the floor cleaning machine, and wherein the moisture sensor is mounted to the trailing mop system.

17. The floor cleaning machine of claim 16, wherein the trailing mop system comprises:

a frame connected to the chassis; and an absorbent medium mounted to the frame to contact the first electrode and the second electrode and positioned to contact the cleaning path and absorb moisture.

* * * * *